US007144332B2

(12) United States Patent
Sugimae et al.

(10) Patent No.: US 7,144,332 B2
(45) Date of Patent: Dec. 5, 2006

(54) FERRULE AND GOLF CLUB INCORPORATING SAME

(75) Inventors: Rich Sugimae, Oceanside, CA (US); Marni Ines, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 169 days.

(21) Appl. No.: 10/668,139

(22) Filed: Sep. 22, 2003

(65) Prior Publication Data

US 2005/0101401 A1 May 12, 2005

(51) Int. Cl.
*A63B 53/02* (2006.01)

(52) U.S. Cl. ..... 473/308

(58) Field of Classification Search ..... 473/308–310
See application file for complete search history.

(56) References Cited

U.S. PATENT DOCUMENTS

| | | | | |
|---|---|---|---|---|
| 1,487,707 | A | 3/1924 | Benton | |
| 1,540,559 | A | 6/1925 | Murphy | |
| 1,844,812 | A | 2/1932 | Thorpe | |
| 1,976,324 | A | 10/1934 | Buhrke et al. | 273/80 |
| 1,997,889 | A | 4/1935 | Smith | 273/80 |
| 2,015,253 | A | 9/1935 | Buhrke et al. | 273/80 |
| 3,572,709 | A | 3/1971 | Risher | 273/80 |
| 5,624,330 | A | 4/1997 | Tsuchida | 473/308 |
| 5,711,721 | A | 1/1998 | Johnson et al. | 473/308 |
| 5,797,806 | A * | 8/1998 | Butler | 473/310 |
| 5,863,260 | A | 1/1999 | Butler, Jr. et al. | 473/305 |
| 5,910,056 | A | 6/1999 | Nagamoto et al. | 473/305 |
| 6,352,482 | B1 | 3/2002 | Jacobson et al. | 473/310 |

FOREIGN PATENT DOCUMENTS

| | | |
|---|---|---|
| JP | 9075484 | 3/1997 |
| JP | 2000042146 A | 2/2000 |
| JP | 2003-093551 | 2/2003 |

* cited by examiner

*Primary Examiner*—Stephen Blau
(74) *Attorney, Agent, or Firm*—Sheppard, Mullin, Richter & Hampton LLP

(57) ABSTRACT

A golf club including a golf club head, a hosel, a ferrule, and a shaft. The hosel defines a cavity having an opening at an upper end of the hosel and an annular recess at an outer surface of the hosel. The ferrule defines an axial bore and has an annual ridge positioned within the axial bore. The ferrule also has a bottom portion that surrounds the upper end of the hosel. The shaft includes an upper end adapted to be gripped by a golfer and a lower end that extends through the axial bore and into the cavity defined by the hosel. The annular ridge and the annular recess engage each other in an interlocking fashion to inhibit rotation and longitudinal movement of the ferrule.

13 Claims, 6 Drawing Sheets

FERRULE AND GOLF CLUB INCORPORATING SAME

BACKGROUND OF TH INVENTION

The present invention relates generally to golf clubs and, more particularly, a ferrule and hosel geometry for a golf club.

Golf clubs include a club head mounted to a tip of a shaft. Typically, the club head includes a cylindrical hosel that defines an opening for receiving the tip of the shaft. It is important that the junction of the hosel and shaft has sufficient strength for the rigors the golf club must endure. Also, abrupt edges at this junction lack esthetic appeal and can be a safety issue. To alleviate such concerns, sleeves positioned about the club shaft, referred to as ferrules, have been used.

Ferrules commonly are configured to have a lower portion positioned between the tip of the shaft and the hosel and to have an upper portion snug fit to the shaft. After prolonged use and exposure, such ferrules can loosen about the shaft and inhibit club performance. Alternatively, ferrules can be attached with adhesive to promote durability. However, caution must be taken during assembly to ensure that the ferrule does not separate from or twist about the hosel, particularly prior to setting of the adhesive. During club assembly, ferrules often must be polished by hand to be flush about the diameter of the hosel for a smooth, cosmetic transition between the shaft and the head. This process can be costly and time consuming.

It should, therefore, be appreciated that there exists a need for a ferrule for a golf club having improved durability and improved ease of assembly. The present invention fulfills this need and others.

SUMMARY OF THE INVENTION

The present invention provides a ferrule, and a golf club incorporating same, configured for improved durability and ease of assembly. The ferrule defines an axial bore for receiving a club shaft therethrough. A bottom portion of the ferrule is sized to receive and surround an upper end of a hosel of a club head. The hosel and the ferrule are cooperatively configured to inhibit movement of the ferrule and, preferably, axial rotation and longitudinal movement of the ferrule are both inhibited by engagement of corresponding surfaces of the ferrule and the hosel.

In a preferred embodiment, a plurality of protrusions, ribs and/or grooves are provided on an interior surface of the ferrule. More particularly, protrusions at an upper, interior surface of the ferrule body serve to help center the shaft tip within the ferrule body. Also, a lower interior surface of the ferrule can include an annular protrusion that mates with an annular groove defined in by the upper, exterior surface of the hosel.

In a detailed aspect of a preferred embodiment, a plurality of ribs at a lower, interior surface of the ferrule are received in corresponding grooves formed on an upper exterior surface of the club head hosel. These ribs serve to locate and initially fix the ferrule onto the hosel of the club head. Alternatively, the grooves may be provided on the ferrule and the ribs on the hosel. Preferably, a chamfer is provided at an exterior surface of a lower end of the ferrule.

In another preferred embodiment, the hosel includes an outer surface having at least one strut configured to inhibit axial rotation of the ferrule. Preferably, the strut has a knife-like edge configured to cut into the interior surface of the ferrule, thereby inhibiting axial rotation.

In a preferred method of assembly, savings in time and labor are achieved in that a ferrule may be provided on either the head or shaft prior to shipping by a vendor, excess adhesive is simply wiped off the club during final assembly and because of the net fit no grinding is required to match the ferrule and hosel diameters, thus preserving cosmetic features on the ferrule.

For purposes of summarizing the invention and the advantages achieved over the prior art, certain advantages of the invention have been described herein above. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment disclosed.

BRIEF DESCRIPTION OF THE DRAWINGS

Embodiments of the present invention will now be described, by way of example only, with reference to the following drawings in which.

DETAILED DESCRIPTION OF THE PREFERRED EMBODIMENTS

Figure 1:
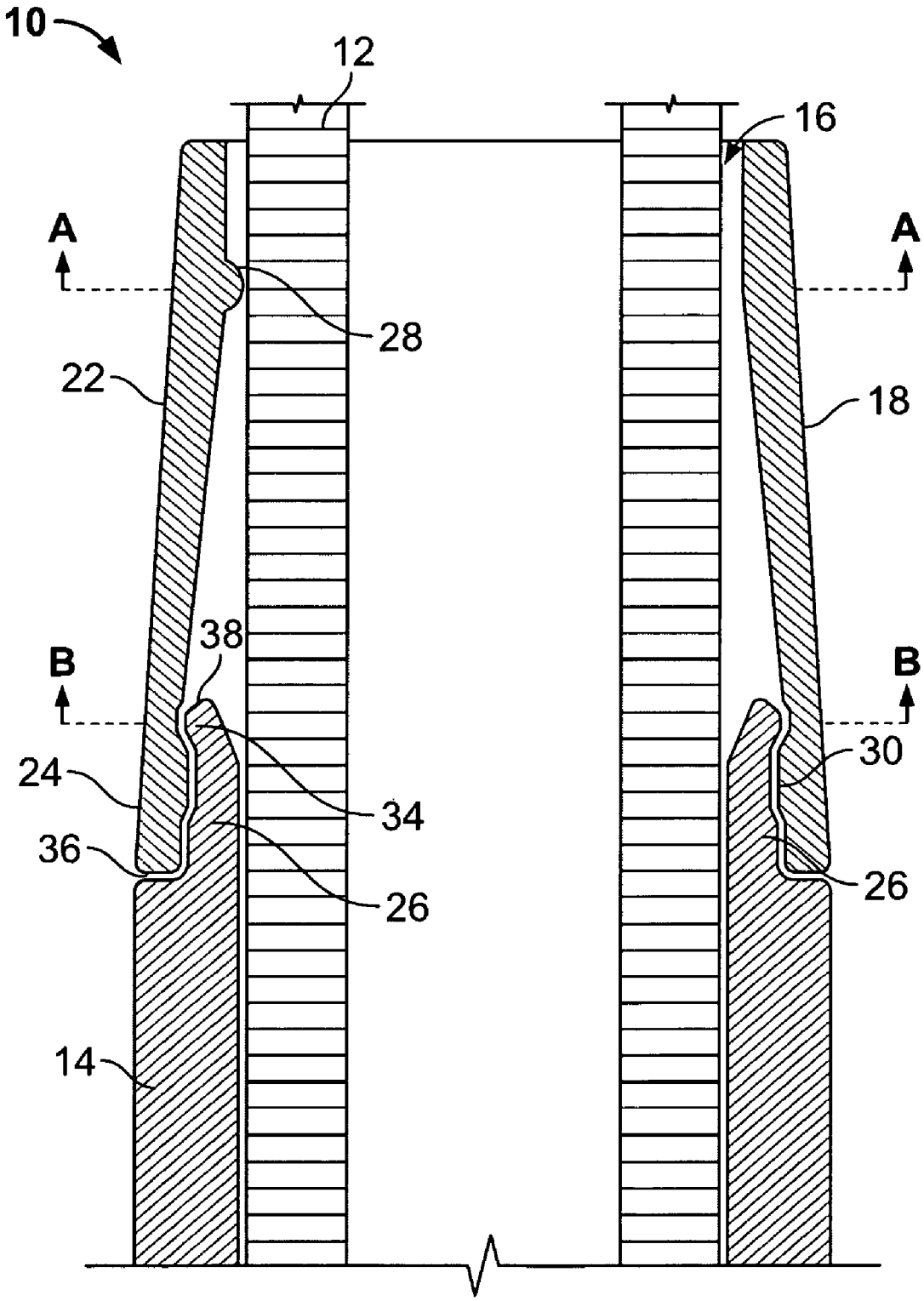
FIG. 1 is a cross-sectional view of a golf club in accordance with the invention, depicting a ferrule at a junction of a club shaft and hosel portion of a club head.

With reference to the illustrative drawings, and particularly to FIG. 1, there is shown a junction portion of a golf club 10 in which a club shaft 12 and a hosel 14 are received within a bore 16 of a ferrule 18. The ferrule includes an upper portion 22 positioned about the shaft and a lower portion 24 positioned about an end 26 of the hosel. The upper portion includes protrusions 28 that serve to align the shaft within the bore of the ferrule. The lower portion of the ferrule is configured to cooperatively engage the end of the hosel such that the ferrule is securely affixed to the hosel and, to that end, the ferrule includes an annular ridge 30 adjacent to a lower opening 32 (FIG. 7) of the bore. The ridge engages a recessed portion 34 of the hosel, maintaining the ferrule in place. The lower edge 36 of the ferrule preferably is chamfered or rounded to facilitate installation onto the hosel. Moreover, the lower portion of the ferrule and the end of the hosel are cooperatively configured to inhibit axial rotation of the ferrule.

Figure 2:
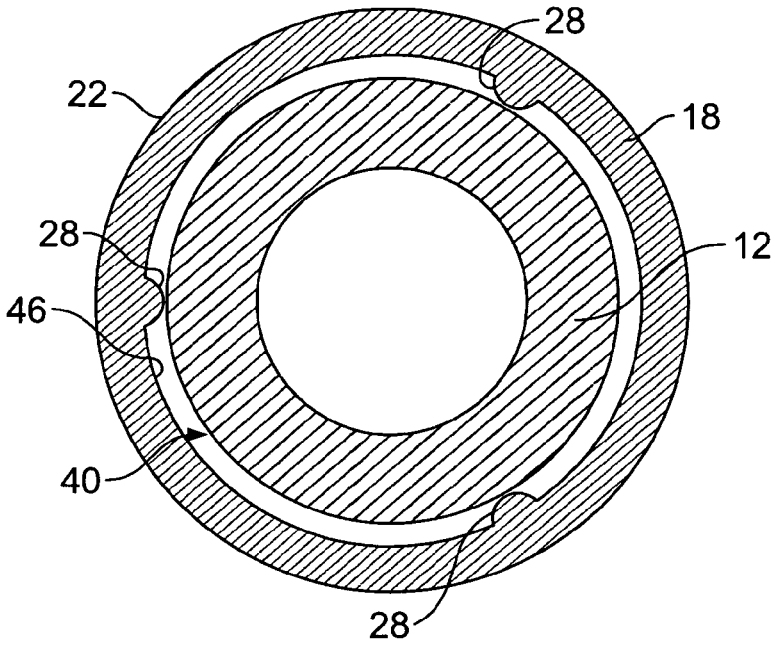
FIG. 2 is a cross-section view taken along line A—A of the golf club of FIG. 1, depicting protrusions of the ferrule in contact with the shaft.

With reference to FIG. 2, the protrusions 28 at the upper portion 22 of the ferrule aid in centering the shaft within the bore 16 providing a cavity 40. The cavity facilitates a flow of adhesive between the shaft, hosel and ferrule, thereby promoting a secure and durable bond amongst these components. During assembly, excess adhesive can flow past the protrusions and out an upper opening 42 (FIG. 7) of the bore, as needed. Thereafter, excess adhesive can simply be wiped off. Although the present embodiment employs three protrusions, other embodiments having different numbers of protrusions and having protrusion of different configurations are contemplated.

Figure 3:
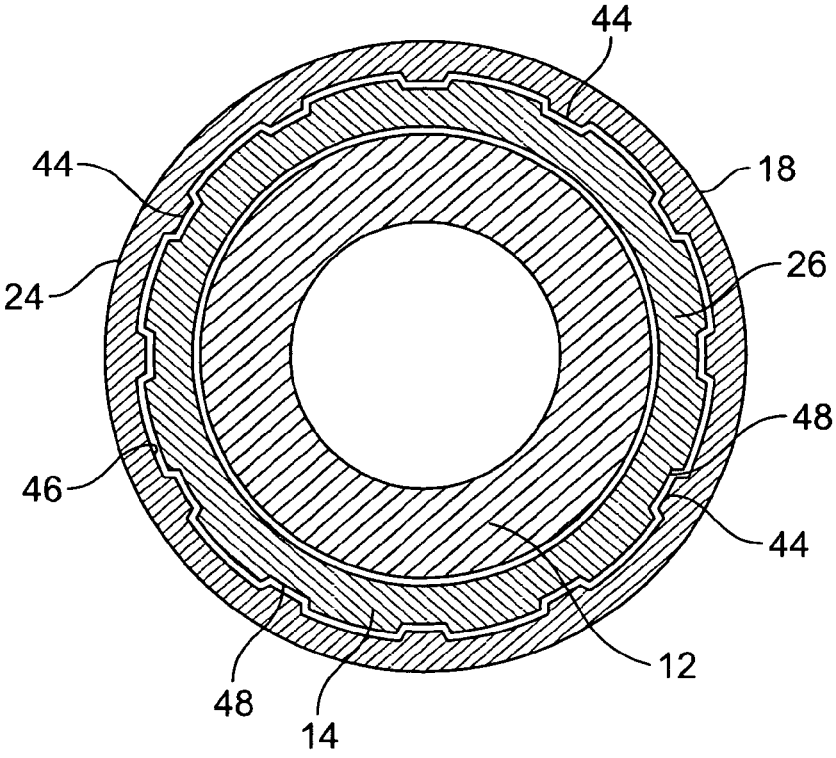
FIG. 3 is a cross-sectional view taken along line B—B of the golf club of FIG. 1, depicting a conforming interface between the ferrule and hosel.
Figure 7:
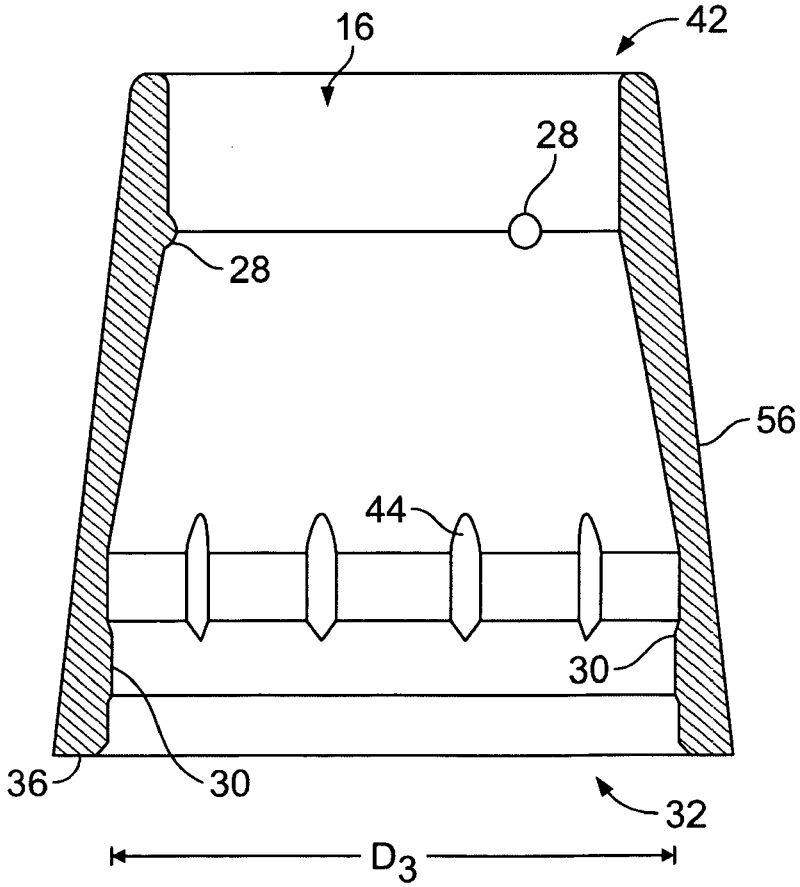
FIG. 7 is a cross-sectional view of the ferrule of FIG. 1.

With reference now to FIG. 3, the lower portion 24 of the ferrule and the end 26 of the hosel cooperatively engage to inhibit rotation of the ferrule about the hosel. More particularly, the ferrule further includes a plurality of ribs 44 longitudinally aligned about an interior surface 46 and positioned above the annular ridge 30 (FIG. 7). The ribs are received in corresponding grooves 48 formed on an upper exterior surface of the hosel. In this manner, the hosel and the ferrule cooperative to inhibit axial rotation of the ferrule, this facilitates assembly and the setting of the adhesive. In the exemplary embodiment, the ribs are positioned above the annular ridge. Other structural configurations can be employed to inhibit axial rotation of the ferrule. For example, the ribs and corresponding grooves can be positioned below or incorporated into the annular ridge and the annular recess 34, respectively.

Figure 4:
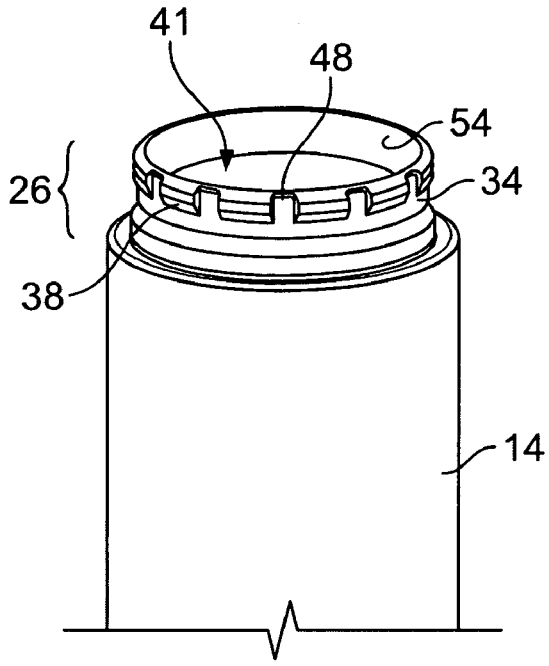
FIG. 4 is a close-up perspective view of the hosel portion of the club head of FIG. 1.
Figure 5:
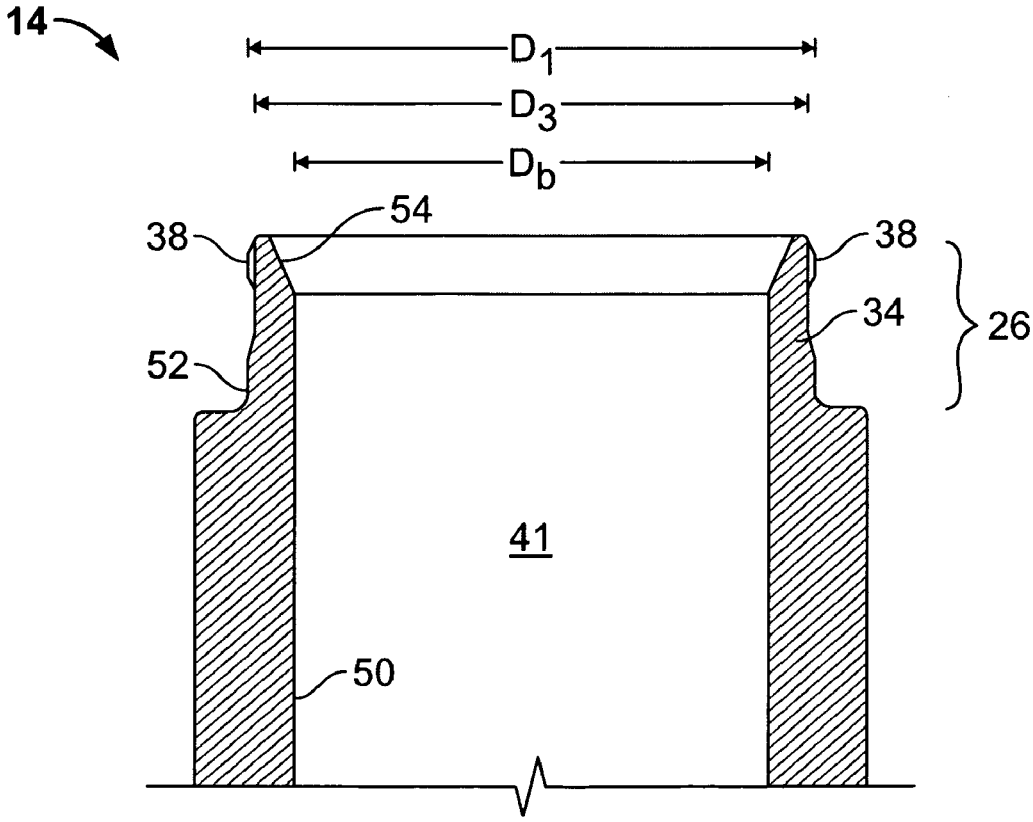
FIG. 5 is a cross-sectional view the hosel portion of the club head of FIG. 1.

With reference to FIGS. 4 and 5, the hosel 14 is generally cylindrical having a centered bore 41 sized to receive the shaft 16. In this embodiment, the hosel bore has a diameter $D_b$ of about 9.6 mm at the upper portion 22 thereof. The hosel bore is defined by an interior surface 50 that includes a tapered portion 54 proximate to the opening into the bore. This tapered portion aids in receiving the shaft into the bore as well as facilitating adhesive flow. As best shown in FIG. 1, even with the shaft in place, the tapered portion affords adhesive flow therein.

The end 26 of the hosel includes a locking rim 38, defining the longitudinal grooves 48 (FIG. 4) spaced there about. The rim further serves to restrict longitudinal movement of the ferrule 18 by interacting with the ridge 30 (FIG. 7). In this embodiment, the hosel has an outer diameter $D_1$ of about 11.63 mm at the rim. Continuing down the outer surface 52 of the hosel, the rim leads to the recessed portion 34, which in this embodiment has an outer diameter $D_2$ of about 11.48 mm. Following the recessed portion the outer surface extends laterally out, defining an annular edge that cooperates with the chamfered edge 36 (FIG. 1) of the ferrule to provide a smooth transition seam between the hosel and the ferrule.

Figure 6:
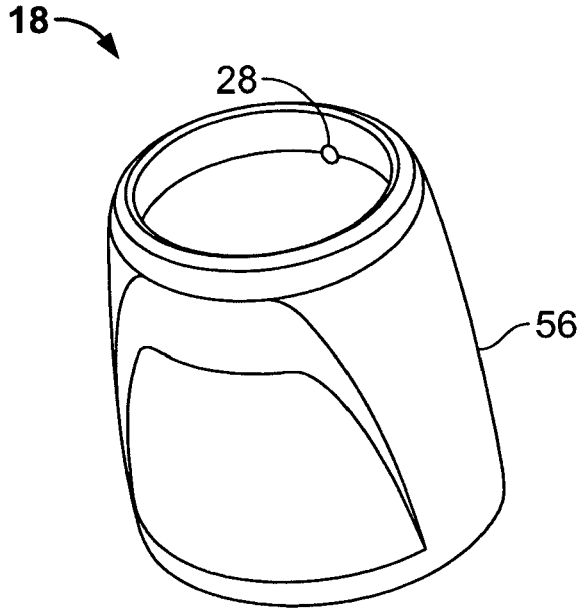
FIG. 6 is a perspective view of the ferrule of FIG. 1.

With reference to FIGS. 6 and 7, the bore 18 of the ferrule has a variable inner diameter profile, including a minimum diameter sufficient to receive the club shaft. At the ridge 30 of the ferrule, an inner diameter $D_3$ is provided, less than both the outer diameter $D_1$ and $D_2$ of the hosel. Here, inner diameter $D_3$ is about 11.35 mm. Thus, in this embodiment, the ferrule deflects as the ridge passes the locking rim 38 of the hosel and securely engages the outer surface of the hosel.

The ferrule is provided with an exterior surface 50 (FIG. 5) that is smoothly tapered across its longitudinal length, providing an aesthetic and functional transition between the club head and the shaft. The exterior surface can be provided with concave regions and/or raised regions to provide identifying indicia on the ferrule. The ferrule 18 is formed of a lightweight yet durable material, e.g., nylon, polycarbonate, and polyoxymethylene. Materials having a density less than about 2 g/cc and a modulus of elasticity no greater than about 3 GPa have been found to be effective. Optionally, a colorant can be added to the material. In the exemplary embodiment, the ferrule is formed of an acetal resin compound commonly known as Delrin®, from E.I. du Pont de Nemours and Co.

Figure 8:
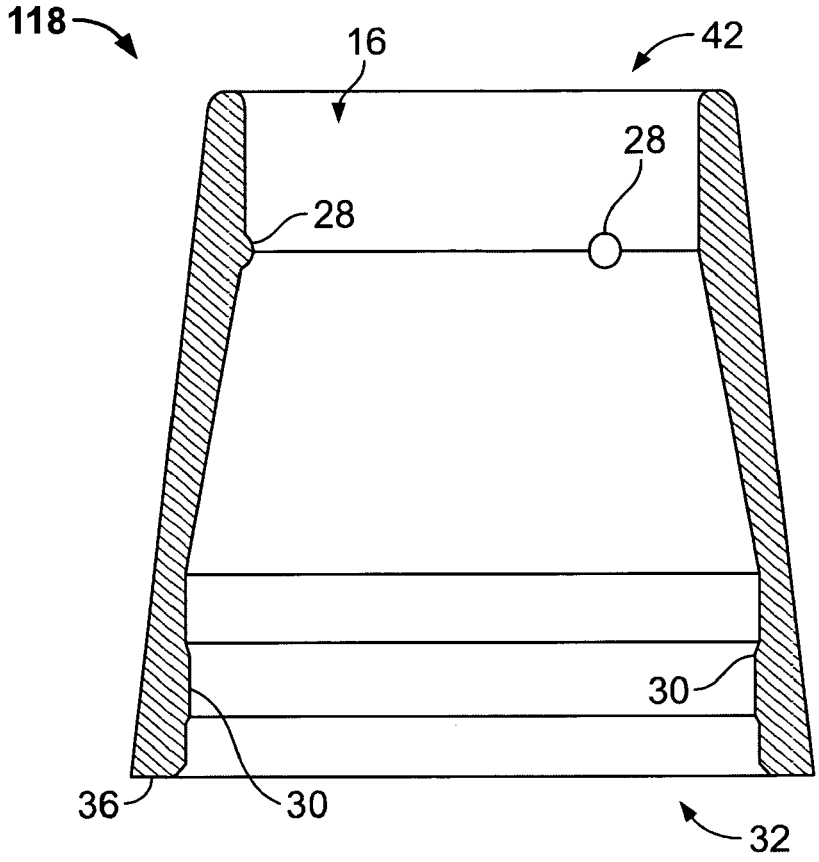
FIG. 8 is a cross-sectional view a ferrule in another embodiment in accordance with the invention.
Figure 9:
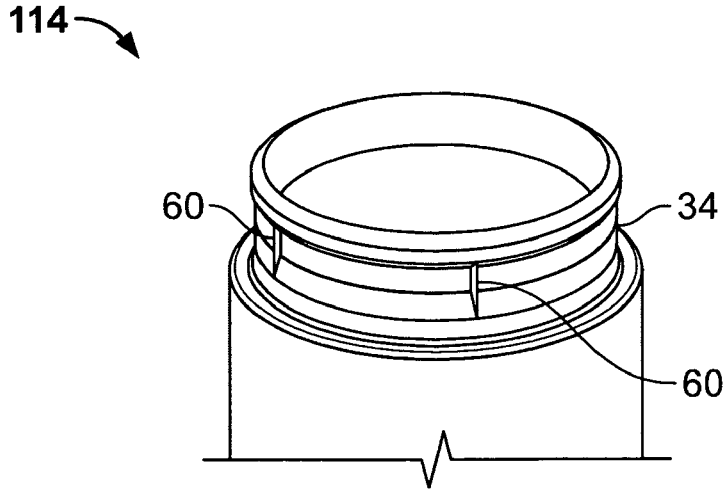
FIG. 9 is a perspective view of a hosel portion corresponding to the ferrule of FIG. 8.
Figure 10:
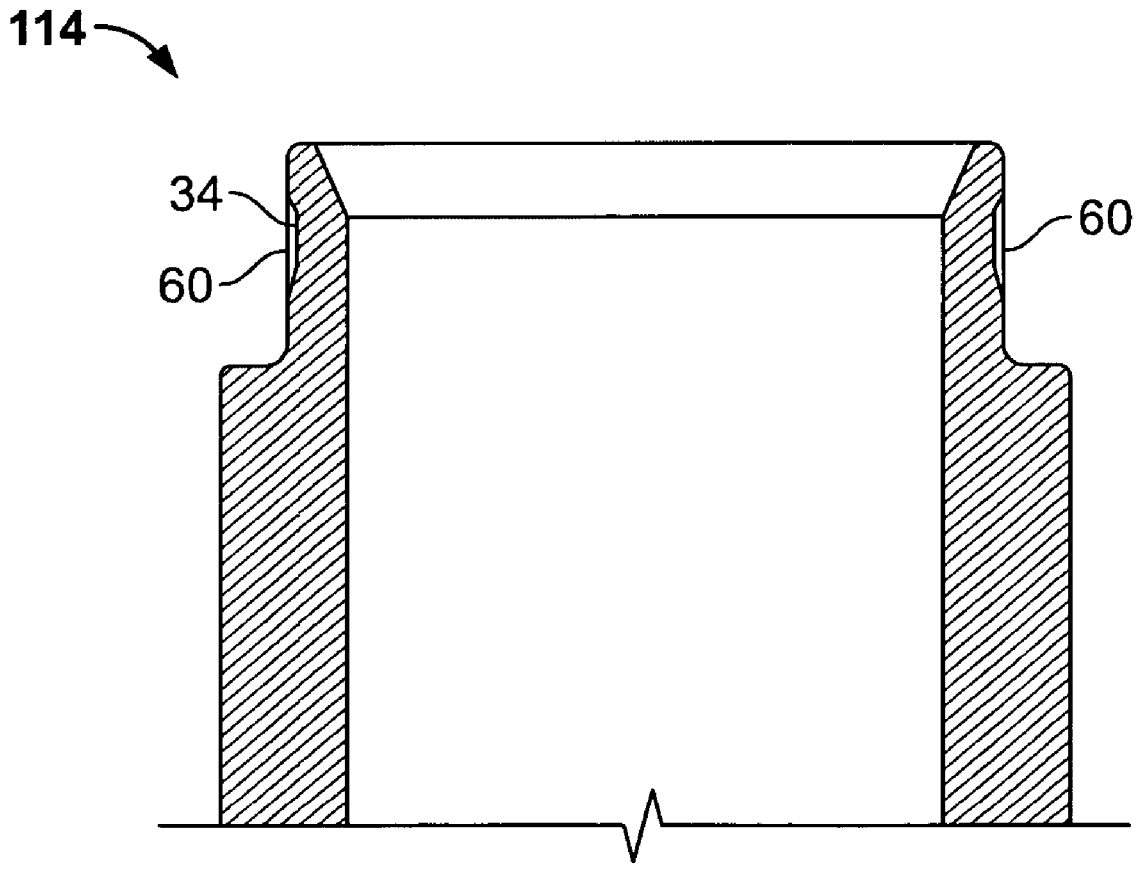
FIG. 10 is a cross-sectional view of the hosel of FIG. 9.

Alternative embodiments of a hosel 114 and a ferrule 118 are shown in FIGS. 8–10, with like numerals referring to like elements. With reference to FIG. 8, the ferrule 118 may be substantially the same as shown in FIG. 7, absent the plurality of ribs 44 about the annular ridge 30. In place of the ribs 44 on the ferrule being received in corresponding grooves formed in the hosel, longitudinal struts 60 shown in FIGS. 9–10 are provided on the recessed portion 34 of the hosel 114 to inhibit axial rotation of the ferrule. The struts are relatively thin and form knife-like edges that cut into annular ridge of the ferrule to inhibit axial rotation thereof. A single strut or a plurality of struts may be provided, as desired. The preferred embodiment shown in FIGS. 9–11 has four struts equally spaced about the hosel.

With reference again to FIG. 1, the golf club 10 is configured for easy assembly. In an exemplary approach, the ferrule 18 is pre-positioned on either the head or the shaft 12. The ferrule can be positioned even prior to shipment of either the head or the shaft by a vendor. Adhesive is applied in the opening of the hosel, and the tip of shaft is then inserted. In addition or alternatively, adhesive can be applied directly to the shaft and/or the ferrule prior to insertion. Regardless of the approach, the cavity 40 (FIG. 2) defined therein enables effective flow of the adhesive amongst the components. Excess adhesive can exit the cavity, allowing it to be wiped off. The ferrule is positioned over the upper end of the hosel, such that the annular ridge 30 of the ferrule is received within the annular recess of the hosel. Once positioned, axial rotation of the ferrule is inhibited, which facilitates the setting of the adhesive.

It should be appreciated from the foregoing that the present invention provides a ferrule, and a golf club incorporating same, configured for improved durability and ease of assembly. The ferrule defines an axial bore for receiving a club shaft therethrough. A bottom portion of the ferrule is sized to receive and surround an upper end of a hosel of a club head. The hosel and the ferrule are cooperatively configured to inhibit movement of the ferrule. In a preferred embodiment, axial rotation and longitudinal movement of the ferrule are both inhibited by engagement of corresponding surfaces of the ferrule and the hosel. Alternatively, the hosel may include at least one strut having a knife-like edge configured to cut into the interior surface of the ferrule, thereby inhibiting axial rotation. The ferrule can be provided with protrusions.

Although the invention has been disclosed in detail with reference only to the preferred embodiments, those skilled in the art will appreciate that additional ferrules and golf club incorporating same can be included without departing from the scope of the invention. Accordingly, the invention is defined only by the claims set forth below.

We claim:

1. A ferrule for a golf club, comprising:

a body having an upper portion and a lower portion that cooperatively define an axial bore extending the entire longitudinal length of the body for receiving a golf club shaft therethrough;

wherein the upper portion includes a plurality of protrusions positioned on an interior surface in the axial bore; and wherein the lower portion is further configured to receive an end of a hosel of a golf club head into the axial bore, the lower portion having an interior surface about the axial bore configured to cooperate with the end of the hosel to inhibit axial rotation of the ferrule about the hosel.

2. A ferrule as defined in claim 1, wherein the lower portion includes an annular ridge positioned in the axial bore and configured to cooperate with an annular recess defined on an outer surface of the hosel to inhibit longitudinal movement of the ferrule.

3. A fernile as defined in claim 1, further comprising at least one rib formed on the interior surface of the lower portion of the body and configured to be received within a corresponding groove defined on the outer surface of the hosel to inhibit axial rotation of the ferrule.

4. A ferrule as defined in claim 1, further comprising at least one groove formed on an interior surface of the lower portion of the body and configured to receive a corresponding rib on the outer surface of the hosel to inhibit axial rotation of the ferrule.

5. A ferrule as defined in claim 1, further comprising a chamfer surface at a bottom end of the body.

6. A ferrule as defined in claim 1, wherein the axial bore has a variable diameter profile including a first inner diameter at the upper portion that is smaller than a second inner diameter at the lower portion, the second inner diameter sized to receive the tip of the golf club shaft and the end of the hosel of the golf club head.

7. A ferrule as defined in claim 1, wherein the body is formed of a material having a density less than about 2 g/cc and a modulus of elasticity no greater than about 3 GPa.

8. A golf club, comprising:

a golf club head having a hosel, the hosel defining a cavity having an opening at an upper end of the hosel and an annular recess on an outer surface of the hosel;

a shaft having an upper end adapted to be gripped by a golfer and a lower end extending into the cavity defined by the hosel; and a ferrule defining an axial bore and having the shaft extending therethrough, the ferrule having a bottom portion surrounding the upper end of the hosel and an annular ridge positioned within the axial bore;

wherein the annular ridge and the annular recess engage each other in an interlocking fashion to inhibit axial rotation and longitudinal movement of the ferrule.

9. A golf club, comprising:

a golf club head having a hosel, the hosel defining a cavity having an opening at an upper end of the hosel;

a shaft having an upper end adapted to be gripped by a golfer and a lower end extending into the cavity defined by the hosel; and a ferrule defining an axial bore and having the shaft extending therethrough, the ferrule having a bottom portion surrounding the upper end of the hosel and a plurality of protrusions positioned on an interior surface of the axial bore in contact with the shaft such that the ferrule and the shaft define a cavity therebetween;

wherein the hosel and the ferrule have corresponding surfaces that engage each other in an interlocking fashion to inhibit axial rotation and longitudinal movement of the ferrule.

10. A golf club, comprising:

a golf club head having a hosel, the hosel defining a cavity having an opening at an upper end of the hosel and a groove on an outer surface of the hosel;

a shaft having an upper end adapted to be gripped by a golfer and a lower end extending into the cavity defined by the hosel; and a ferrule defining an axial bore and having the shaft extending therethrough, the ferrule having a bottom portion surrounding the upper end of the hosel and a longitudinal rib formed within the axial bore;

wherein the groove on the outer surface of the hosel and the longitudinal rib formed within the axial bore engage each other in an interlocking fashion to inhibit axial rotation and longitudinal movement of the ferrule.

11. A golf club as defined in claim 10, the corresponding surfaces of the ferrule and the hosel further including an annular ridge positioned within the axial bore of the ferrule and an annular recess defined on an outer surface of the hosel.

12. A golf club as defined in claim 11, wherein the axial bore has a variable diameter profile including a first inner diameter at an upper portion that is smaller than a second inner diameter at the bottom portion, the second inner diameter sized to receive the shaft and the end of the hosel of the golf club head.

13. A golf club as defined in claim 11, the ferrule having a chamfered or rounded, annular edge formed on a bottom end thereof.

* * * * *

UNITED STATES PATENT AND TRADEMARK OFFICE

CERTIFICATE OF CORRECTION

PATENT NO. : 7,144,332 B2
APPLICATION NO. : 10/668139
DATED : December 5, 2006
INVENTOR(S) : Sugimae et al.

It is certified that error appears in the above-identified patent and that said Letters Patent is hereby corrected as shown below:

At Column 5, line 21, “fenile” should be -- ferrule --.

Signed and Sealed this

Twenty-seventh Day of March, 2007

JON W. DUDAS
*Director of the United States Patent and Trademark Office*